US008950116B2

(12) United States Patent
Rydén et al.

(10) Patent No.: US 8,950,116 B2
(45) Date of Patent: Feb. 10, 2015

(54) SLIDING DOOR ARRANGEMENT

(75) Inventors: Lars Rydén, Västervik (SE); Peter Nilsson, Västervik (SE)

(73) Assignee: Elfa International AB, Vastervik (SE)

( * ) Notice: Subject to any disclaimer, the term of this patent is extended or adjusted under 35 U.S.C. 154(b) by 14 days.

(21) Appl. No.: 13/638,568

(22) PCT Filed: Mar. 31, 2011

(86) PCT No.: PCT/EP2011/055006

§ 371 (c)(1),
(2), (4) Date: Feb. 15, 2013

(87) PCT Pub. No.: WO2011/121071

PCT Pub. Date: Oct. 6, 2011

(65) Prior Publication Data

US 2013/0199099 A1 Aug. 8, 2013

(30) Foreign Application Priority Data

Apr. 1, 2010 (EP) ..... 10158957

(51) Int. Cl.
*E05F 11/00* (2006.01)
*E05F 5/00* (2006.01)
*E05F 1/16* (2006.01)

(52) U.S. Cl.
CPC . *E05F 5/003* (2013.01); *E05F 1/16* (2013.01); *E05F 5/007* (2013.01)
USPC ..... 49/275; 49/404; 16/49

(58) Field of Classification Search
USPC ..... 49/404, 414, 425, 275; 16/49, 103, 105
See application file for complete search history.

(56) References Cited

U.S. PATENT DOCUMENTS

| | | | | |
|---|---|---|---|---|
| 3,085,298 | A | 4/1963 | Metzger | |
| 3,281,993 | A | 11/1966 | Riegelman | |
| 3,514,805 | A | 6/1970 | Foltz | |
| 3,722,028 | A | 3/1973 | Schoenbrod | |
| 4,404,771 | A | 9/1983 | Murase et al. | |
| 5,927,017 | A | 7/1999 | Jacobs et al. | |
| 7,293,389 | B2 * | 11/2007 | Jacobs | 49/425 |
| 8,272,167 | B2 * | 9/2012 | Sato | 49/404 |
| 8,307,497 | B2 * | 11/2012 | Chang et al. | 16/71 |
| 2005/0246962 | A1 | 11/2005 | Jacobs | |
| 2007/0186481 | A1 * | 8/2007 | Tomita et al. | 49/409 |
| 2009/0096339 | A1 | 4/2009 | Worner | |
| 2011/0101839 | A1 * | 5/2011 | Boks | 312/333 |
| 2011/0175508 | A1 * | 7/2011 | Rechberg et al. | 312/334.8 |
| 2013/0167444 | A1 * | 7/2013 | Ryden et al. | 49/417 |

FOREIGN PATENT DOCUMENTS

| | | | |
|---|---|---|---|
| DE | 10301121 | A1 | 7/2003 |
| EP | 1705330 | A1 * | 9/2006 |
| EP | 2128368 | A1 | 12/2009 |

* cited by examiner

*Primary Examiner* — Katherine Mitchell
*Assistant Examiner* — Catherine A Kelly
(74) *Attorney, Agent, or Firm* — Condo Roccia Koptiw LLP

(57) ABSTRACT

The present disclosure relates to a sliding door arrangement with an attenuation and retraction device facilitating soft-closing of a sliding door. The arrangement includes an attenuation and retraction device, which may be placed in the extension of a rail guiding and retaining the door, and a pin that extends from the door and interacts with the attenuation and retraction device. The pin may optionally be locked in a retracted position during mounting of the door in order to protect the pin from damage resulting from excessive side forces.

20 Claims, 4 Drawing Sheets

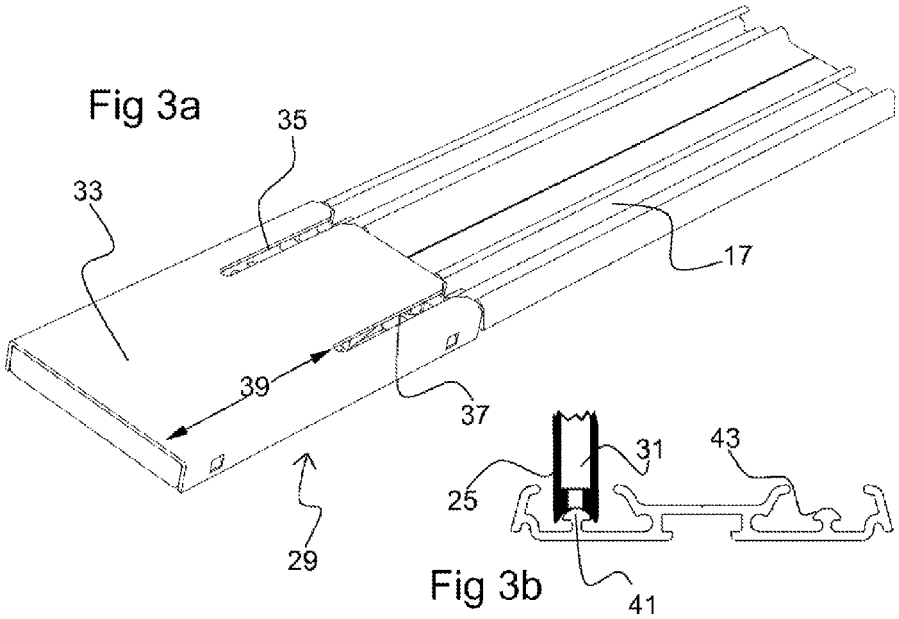
Fig 3a
Fig 3b
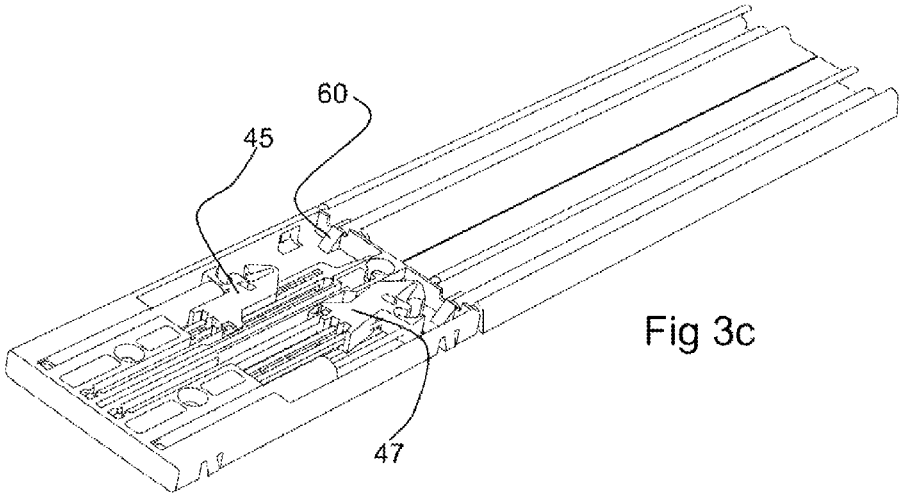
Fig 3c

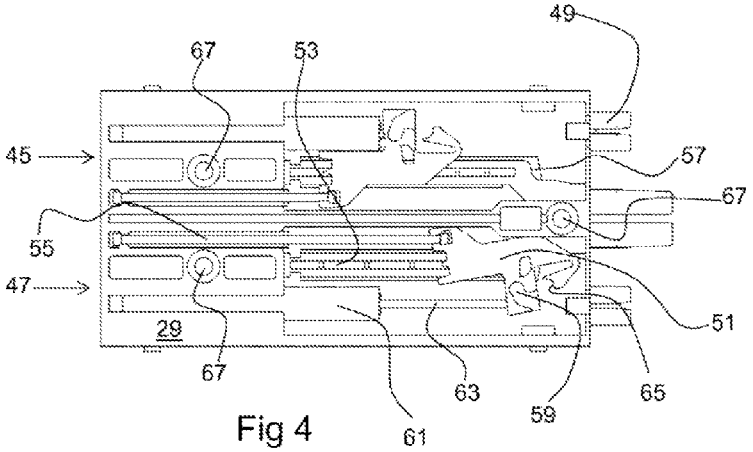
Fig 4
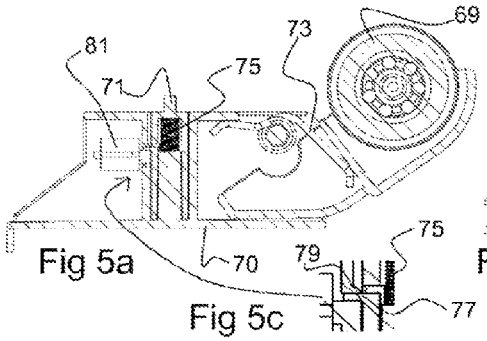
Fig 5a
Fig 5c
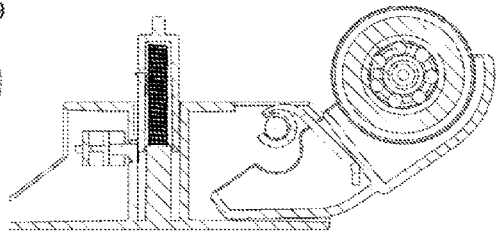
Fig 5b
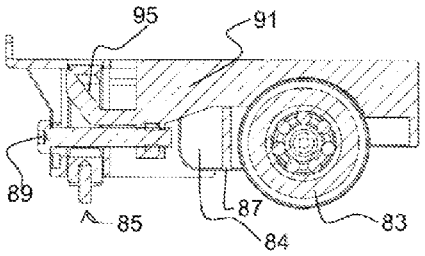
Fig 6a
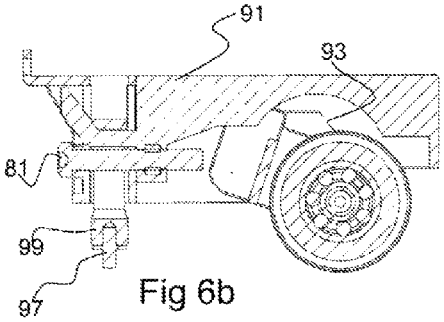
Fig 6b

SLIDING DOOR ARRANGEMENT

This application is the National Stage entry under 35 U.S.C. §371 of PCT Application No. PCT/EP2011/055006 filed Mar. 31, 2011; which claims the benefit of European Patent Application No. 10158957.0, filed Apr. 1, 2010, the disclosures of which are herein incorporated by reference in their entirety.

TECHNICAL FIELD

The present invention relates to a sliding door arrangement including at least one sliding door, a rail system, comprising at least a first rail which guides a sliding motion of the door, and an attenuation and retraction device, which brakes the sliding motion of the door at a brake position in the vicinity of a door end position and retracts the door to the end position.

BACKGROUND

Such a door arrangement is disclosed e.g. in US 2009/0096339 A1, where an attenuation and retraction device is hidden inside a rail element. Other arrangements are known where the attenuation and retraction devices are placed at the midpoint of a door's long edge. In the first case, such known solutions suffer from being relatively complex and very difficult to assemble, adjust or repair for an end user. In the latter case, the solution suffers from the attenuation and retraction device extending from the side wall in an obstructive way. Additionally, with such an attenuation and retraction device, the door becomes very difficult to adjust, e.g. in order to compensate for a side wall of an opening to be closed by the door deviating lightly from the vertical.

SUMMARY

One object of the present invention is therefore to provide a sliding door arrangement which is easy to assemble, adjust or repair and does not appear obstructive in the normal use of the door arrangement.

This object is achieved by means of a sliding door arrangement as defined in the appended claims. More specifically, a sliding door arrangement of the initially mentioned kind then includes an attenuation and retraction device which is placed in the extension of the first rail. As the attenuation and retraction device is placed in the extension of the rail rather than in the rail, the device can easily be replaced. Further, the location of the attenuation and retraction device renders it non-obstructive during normal use of the door arrangement.

The sliding door arrangement may include a door with a pin, the distal end of which faces said first rail, and where the pin is arranged to interact with said attenuation and retraction device when reaching the brake position. The pin allows interaction between the door and the attenuation and retraction device, without the attenuation and retraction device having any protruding parts.

The pin may be urged towards the first rail before reaching the attenuation and retraction device. This makes sure that the pin snaps into the attenuation and retractions device in a reliable manner to interact with the latter.

The attenuation and retraction device may include a slit which the pin enters at the brake position, causing the pin to interact with the attenuation and retraction device, and in which the pin travels to the end position of the door. Such a slit provides a very exact interaction between the pin and the attenuation and retraction device.

The first rail and the attenuation and retraction device may be devised to be mounted above the door. In such a case, the pin may be urged by a spring towards a track of the first rail.

The first rail and the attenuation and retraction device may also be devised to be arranged below the door. In such a case, the pin may be spring loaded as well, but another option is to use the pin's own weight to urge it downwards. The weight of the pin may then preferably exceed 7 grams. In one embodiment the pin may include a distal end, arranged to interact with the attenuation and retraction device, and a proximal end which is attached to the door in a slideable way. The pin may have a thinner portion at the distal end and a thicker portion at the proximal end, the weight of the thicker portion exceeding the weight of the thinner portion by at least a factor 5.

The arrangement may comprise a ramp surface at an interface between the first rail and the attenuation and retraction device, the ramp surface being arranged to guide the pin out of a slit in the attenuation and retraction device and up on a track of the first rail.

BRIEF DESCRIPTION OF THE DRAWINGS

FIG. 3*a* shows a perspective view of a part of a rail, and an attenuation and retraction device.

FIG. 3*b* shows a cross-section through a rail.

FIG. 3*c* is identical to FIG. 3*a* with the exception that the lid of the attenuation and retraction device is removed.

FIG. 4 is a front view of an attenuation and retraction device.

FIGS. 5*a* and 5*b* illustrates in cross section a combination with a spring-loaded wheel and a pin.

FIG. 5*c* shows an enlarged portion of FIG. 5*a*.

FIGS. 6*a* and 6*b* illustrates in cross section a combination with an adjustable wheel and a pin.

DETAILED DESCRIPTION

The present disclosure relates generally to a sliding door arrangement. Such an arrangement is typically used to delimit a niche or recess, which may be provided with shelves and may be used as a closet. Another use for a sliding door arrangement is as a room dividing device providing a semi-removable wall. Needless to say, there are other uses.

Figure 1:
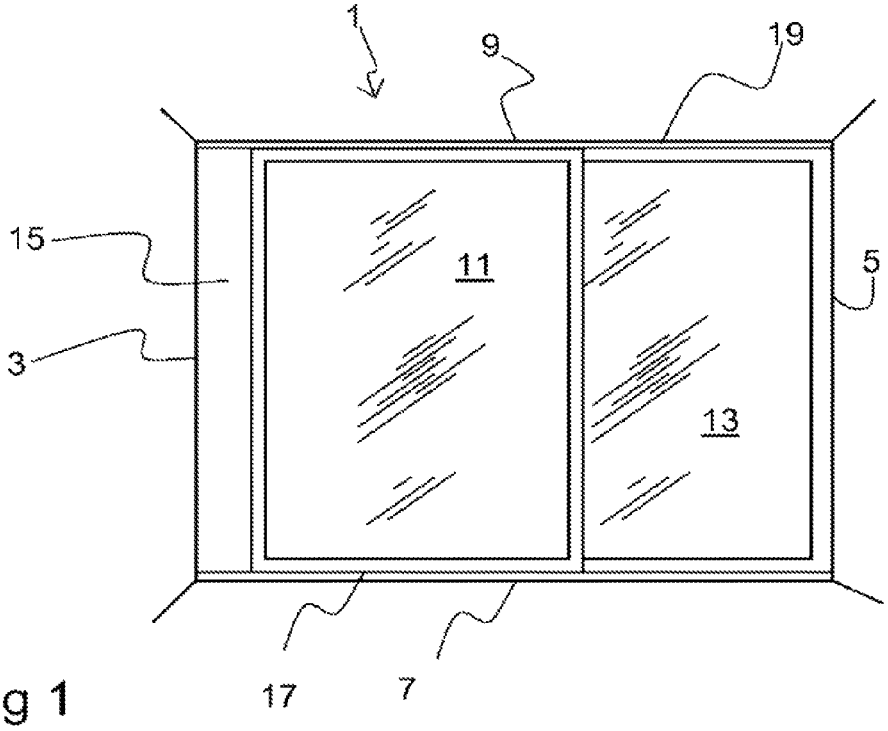
FIG. 1 illustrates schematically a sliding door arrangement.

FIG. 1 illustrates schematically a sliding door arrangement 1. Typically, the door arrangement may be used at the end of a room, extending between a first 3 and a second 5 wall, and between the floor 7 and the ceiling 9. In the illustrated case, only two doors 11, 13 are used, although the number of doors may even exceed five in some applications. The space 15 behind the doors may be provided with shelves and may be used as a closet. When the doors are closed, the space 15 behind the doors is both concealed and protected from dust and the like. The doors may provide mirror panels or decorative panels of different kinds. Usually the total width of the doors exceeds that of the opening such that the doors overlap each other avoiding any gaps between the doors in their closed position.

The sliding doors 11, 13 are mounted between a bottom rail 17 and a top rail 19. As will be shown later, each door may have two top wheels that are resiliently urged towards a track of the top rail 19 and two bottom wheels that rest on a track of the bottom rail 17. As an alternative to a top rail a U-shaped profile may be used. In the illustrated case, the arrangement is fitted between the ceiling and the floor of a room. The arrangement may also be used e.g. in an opening between two rooms, in which case the top rail 19 may instead be fitted under the top piece of the opening.

A sliding door arrangement of this kind may be built in a room from the outset, or may be added later on. Particularly in the latter case, the arrangement may need be adjustable to some extent in order compensate for being used in a not perfectly rectangular opening. For instance, if the second wall 5 is slightly inclined, i.e. deviating slightly from the vertical, the second door 13 may be inclined too, such that its right edge runs parallel with the second wall thereby avoiding any gap between the second door 13 and the second wall 5 at the rightmost position of the former. This can be done by adjusting either or both of the door's bottom wheels, as will be illustrated later.

Figure 2A:
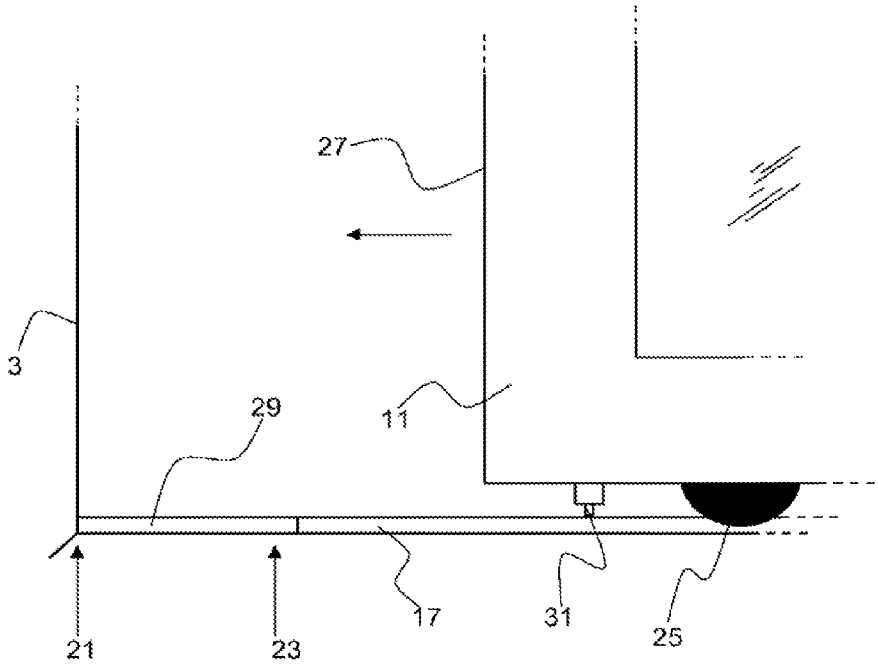
FIG. 2*a* and FIG. 2*b* illustrate various examples of a part of a sliding door arrangement according to the present disclosure.
Figure 2B:
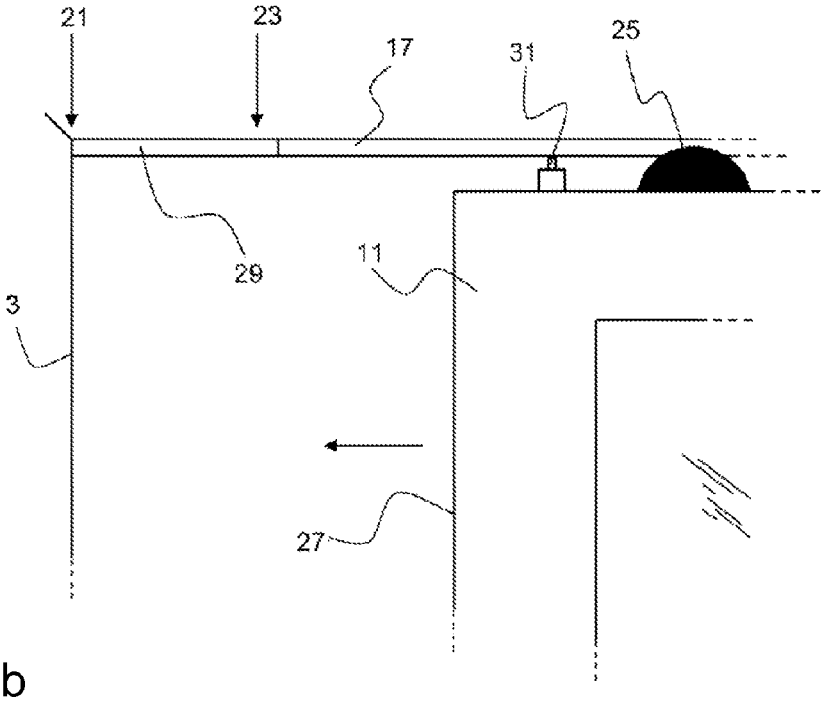

FIG. 2*a* and FIG. 2*b* illustrate examples of a part of a sliding door arrangement according to the present disclosure. The door arrangement is provided with at least one attenuation and retraction device 29. This device is used to provide smooth, silent and accurate operation of the door. The attenuation and retraction device is active in the vicinity of an end position 21 of the door 11, i.e. where the door reaches the left wall 3. When the door 11 approaches this end position it reaches a brake position 23 at which point a pin 31 of the door interacts with the attenuation and retraction device which begins to absorb the kinetic energy of the door 11. At the same time, the attenuation and retraction device pulls in the door 11 to the end position 21. This feature results in the door being completely shut thanks to the retraction function. At the same time, it is prevented that the door 11 slams into the wall 3 thanks to the attenuating/braking function. It should be noted that a door of this type may typically weigh up to 30 kg or even more. Attenuation and retraction devices providing soft-close functions are, as mentioned, per se well known in many applications such as drawers and the like.

As the wheels 25 of the door (e.g., bottom wheels as shown in FIG. 2*a* and/or top wheels as shown in FIG. 2*b*) need not be placed at the side edge 27 of the door, the rail 17 which carries the door 11 need not extend all the way to the wall 3. This provides the opportunity to place the attenuation and retraction device 29 in the elongation of the rail 17. A reliable and non-obstructive device is therefore provided. The attenuation and retraction device 29 interacts with the pin 31, which is attached to the door 11, as will be disclosed below.

FIG. 3*a* shows a perspective view of a part of a rail 17, and an attenuation and retraction device 29. As can be seen, the attenuation and retraction device makes up an extension or prolongation of, and has the same width as the rail, even if this is not necessary. The attenuation and retraction device 29 is provided with a lid 33 which protects its inner mechanism. The lid has a first 35 and a second slit 37, as the attenuation and retraction device 29 is capable of handling two doors, each running on a track of the rail 17. The pin of each door can interact with the attenuation and retraction through the corresponding slit. The pin enters the slit, at the end thereof facing the rail, at the brake position of the door, and travels in the slit to the end position of the door. The remaining length 39 of the attenuation and retraction device should not exceed the distance between the pin 31 and the side edge (cf. 27, FIG. 2) of the door if the door is to be fully shut. It should be noted that only one, or more than two slits may be provided depending on the configuration of the sliding door arrangement and the rail.

FIG. 3*b* shows a cross-section through a rail 17. The illustrated rail has two protruding tracks 41, 43, each capable of carrying one or more doors. The rail 17 may typically be produced as an extruded aluminum profile, even if other materials are conceivable, e.g. plastic or steel. On the first track 41 a wheel 25 of a door and a door pin 31 are partly illustrated. As can be seen, the wheel has a surface forming a groove facing the track 41 in order to be guided by the track. The wheel thus has a minimum diameter in the groove and a maximum diameter on its sides. The illustrated door pin 31 may be urged towards the track 41 in a manner to be shown later. This implies that, when the pin reaches the slit of an attenuation and retraction device, it may extend and snap into the slit in order to ensure the attenuation and retraction function.

FIG. 3*c* is identical to FIG. 3*a* with the exception that the lid of the attenuation and retraction device is removed. As can be seen, the attenuation and retraction device has two individually operable units, where one 45 is in the retracted state and the other 47 is in the non-retracted state as will now be explained further with reference to FIG. 4. The lid may be made of sheet metal or plastic.

FIG. 4 shows a front view of an attenuation and retraction device 29 with two units 45, 47, capable of serving two doors on two tracks. The attenuation and retraction device has a number of projecting tongues 49 which can extend into a rail (cf. 17, FIG. 3*a*) in order to facilitate excellent alignment between the tracks of the rail and the slits in the attenuation and retraction device lid.

The lower unit 47 includes a slider 51 which is arranged to slide on a track 53. In the non-retracted state of the lower unit, the slider 51 is urged towards the retracted position by means of a stretched spring 55 (for heavy doors, double springs may be used). However in this position, the slider is locked on a shoulder portion 57 of the rail 53 (shoulder portion is concealed in the lower unit 47, visible in the upper unit 45).

When the pin 31 of the door reaches the attenuation and retraction device it enters into a recess 59 in the slider 51. This rotates the slider 51 such that it snaps out of the shoulder portion, locks the pin in the recess, and begins travelling on the rail 53 towards the retracted position, driven by the force of the spring 55. At the same time a shock absorber 61, having a piston 63 abutting the slider 51, limits the speed of the door. The slider then reaches the retracted position, as illustrated by the upper unit 45, and the door is closed.

In the other direction, when the door is opened, the pin 31 remains in the recess 59 and forces the slider 51 towards the non-retracted position while stretching the spring 55. This proceeds until the slider 51 reaches the shoulder 57 where it rotates slightly and is locked on the shoulder. The pin then disengages with the recess 59 and leaves the attenuation and retraction device. A ramp surface 60 (cf. FIG. 3*c*) forces the pin out of the slit and up on the rail track.

A spring concealed in the shock absorber 61 urges the piston 63 out, such that it always abuts the slider 51. Attenuation and retraction devices per se are well known and can be devised in other ways, the above device being only an example.

A projection 65 is provided on the slider 51 and facilitates straining of the spring 55 if the slider is in the retracted position without the pin being engaged with the recess 59. This may be the case e.g. when the attenuation and retraction device is first used. It is not possible for the pin to enter the recess 59 being in the retracted position. However the pin may snap past the projection 65 such that the pin may catch the slider and stretch the latter to the non-retracted position where the slider is rotated such that the pin may later engage with the recess 59.

One advantage with using the outlined attenuation and retraction device is that it can easily be mounted and easily replaced if necessary. When assembling a sliding door arrangement, the user simply places the attenuation and retraction device in the prolongation of the rail element, fastens the attenuation and retraction device to the ceiling or floor by means of screws extending through holes 67 in the device, and snaps on the cover lid. Alternatively the lid may be provided with through holes such that the screws may be attached therethrough, in which case the lid need never be removed at all.

It should be noted that the pin that interacts with the attenuation and retraction device could be devised as a unit on the door that is fixed in relation to the door. However, it is advantageous to make the pin moveable in relation to the door. For instance, the pin will interact more decisively with an attenuation and retraction device if it is urged to enter the slit in the attenuation and retraction device cover. If the attenuation and retraction device is placed in the extension of the top rail, this may be achieved by urging the pin upwards by means of a spring.

FIGS. 5*a*, 5*b* and 5*c* illustrate a combination with a spring-loaded wheel 69 and a spring loaded pin 71 adapted to be used on the upper side of a door 11. The combination may be produced as a wheel/pin containing cassette or unit 70, including both the wheel 69 and the pin 71, where the wheel is pivotably attached to the unit 70 to extend more or less from the unit, and the pin is slidably attached to the unit. The pin may have a generally cylindrical shape with a narrow tip. The cylindrical shape may be fitted in a corresponding cylindrical cavity in the cassette to provide the sliding function, an abutment (not shown) making sure that the pin does not leave the cavity entirely. The wheel 69 is urged towards an upper rail track (not shown) by means of a spring 73. This keeps the door locked between the upper and lower rails. Usually, two wheels will be used on the upper side of each door, although other configurations are possible. The pin 71 is urged against the top rail by means of a spring 75 as well. This facilitates the pin entering the attenuation and retraction device when reaching the braking position.

When the door is to be mounted between the rails, the spring could however force the pin to a fully extended position which would expose the pin to possibly detrimental side forces. It should be noted in this context that a door may typically weigh 30 kg. In general some kind of movement limiting device may be applied to the pin such that the pin does not extend further from the door than does a nearby situated wheel. Thereby the wheel protects the pin to some extent.

In its simplest form such a movement limiting device may comprise the abutment (not shown) that makes sure that the slideable pin does not leave the unit 70. By allowing the wheel 69 in the free position (cf. FIG. 5*b*) extend more that the pin 71, the pin becomes protected to some extent.

Further, in order to protect the pin from breaking during mounting of the door, the pin may optionally be lockable such that the wheel extends further than the pin from the door thereby protecting the pin. This feature is achieved by means of a lock mechanism illustrated in greater detail in FIG. 5*c* and constituting a temporarily active movement limiting device. The lock mechanism includes a shoulder portion 77 on the body of the pin 71 and a shoulder portion 79 in the goods surrounding the pin 71 in the wheel/pin containing unit 70. When the pin 71 is sufficiently inserted into the wheel/pin containing unit 70, the shoulder portions 77, 79 engage each other such that the pin 71 is locked in this position. This should preferably be the case when the door is to be mounted. When the door is fixed between the upper and lower rails, the pin 71 is released and activated by means of a release trigger 81. The release trigger 81 is pushed, e.g. by means of a screwdriver, and acts upon the pin's shoulder portion 77, such that it disengages with the shoulder portion 79 of the wheel/pin containing unit 70, the pin 71 snaps out until it reaches the track of the upper rail, and the door is ready to use. This position is similar to the one illustrated in FIG. 5*b*.

FIG. 6 illustrates a combination with an adjustable wheel 83 and a slideable pin 85, in a wheel/pin containing unit or cassette, intended to be used at the bottom side of a door 11. In most cases, the bottom wheel will, together with the other bottom wheels, carry the weight of the door and will thus be urged towards the track of the bottom rail without the use of a spring. Advantageously, the wheel is adjustable to extend more or less from the door bottom edge in order to achieve the earlier described feature allowing the door to be aligned with a side wall slightly deviating from the vertical. This is achieved by arranging the wheel 83 in a wheel holder 87 which is pivotable around a pivot 84 where the wheel holder is attached to the wheel/pin containing unit. The wheel 83 is adjustable by means of an adjustment screw 89 which is connected to a transfer element 91. In FIG. 6*a* the transfer element 91 is in its rightmost position, and by turning the adjustment screw 89, the transfer element is moved to the left in the drawing, and ultimately to the position illustrated in FIG. 6*b*. As a result of this movement a first ramp surface 93 on the transfer element 91 forces the wheel holder 87 to turn around its pivot 84, such that the wheel 83 swings out of the wheel/pin containing unit to a greater extent, thereby raising the door at the position of the wheel 83.

The transfer element 91 also includes a second ramp surface 95 which extends through an elongated opening in the pin 85. This means that the maximum extension of the pin 85 from the door can be limited by the corresponding extension of the wheel 83. This allows the extension of the pin 83 to be limited such that it does not extend more than the maximum diameter of the wheel, thereby protecting the pin during the mounting procedure.

The pin 83 in this configuration could be spring loaded as well in order to ensure that the pin enters the slit of the attenuation and retraction device at the brake position. However, in the illustrated embodiment, the pin's own weight is instead used for this purpose. The inventors have found that a weight of about 7 grams is in most cases sufficient to ensure this function. The illustrated pin 83 comprises a lower plastic part 97 and an upper metal part 99. One way of obtaining a slideable pin that has a sufficient weight, not to need be spring loaded, is to use a narrow distal tip end and a thicker proximal end the weight of the thicker part may then exceed the weight of the thinner portion by at least a factor 5.

The invention is not restricted to the above-illustrated embodiments and may be varied and altered in different ways within the scope of the appended claims. For instance, even if in the illustrated embodiment (cf. FIG. 3*a*) the top surface attenuation and retraction device is relatively flush with the maximum height of the rail, this is not necessary, e.g. the attenuation and retraction device may extend higher as long as the device does not obstruct the wheels of the door or the door itself. Such a device may readily also interact with a pin that is fixed on the door.

The pin and the slits of the attenuation and retraction device need not be aligned with the tracks of the rail.

The invention claimed is:

1. A sliding door arrangement comprising:

at least one sliding door;

a rail system comprising:

at least a first rail configured to guide a sliding motion of the at least one sliding door; and an attenuation and retraction device configured to brake the sliding motion of the at least one sliding door at a brake position in the vicinity of a door end position, and to retract the door to the end position, wherein the attenuation and retraction device is located in a linear extension that is adjacent to said first rail such that an end of the attenuation and retraction device abuts an end of said first rail.

2. A sliding door arrangement according to claim 1, wherein said at least one door includes a pin, the distal end of which faces said first rail, and said pin is arranged to interact with said attenuation and retraction device when reaching the brake position.

3. A sliding door arrangement according to claim 2, wherein said attenuation and retraction device includes a slit configured to receive the pin at the brake position, causing the pin to interact with the attenuation and retraction device, and in which the pin travels to the end position of the door.

4. A sliding door arrangement according to claim 1, wherein said first rail and said attenuation and retraction device are arranged to be mounted above the door.

5. A sliding door according to claim 4, wherein said pin is configured to be displaced by a spring towards a track of said first rail.

6. A sliding door arrangement according to claim 1, wherein said first rail and said attenuation and retraction device are arranged to be mounted below the door.

7. A sliding door arrangement according to claim 6, wherein said pin comprises a distal end arranged to interact with the attenuation and retraction device, and a proximal end attached to the door in a slideable way, wherein the pin has a thinner portion at the distal end and a thicker portion at the proximal end, the weight of the thicker portion exceeding the weight of the thinner portion by at least a factor 5.

8. A sliding door arrangement according to claim 1, wherein the attenuation and retraction device is removeable from the sliding door arrangement without disturbing said first rail.

9. A sliding door arrangement according to claim 1, comprising a ramp surface at an interface between the first rail and the attenuation and retraction device, the ramp surface being arranged to guide a pin out of a slit in the attenuation and retraction device and up on a track of the first rail.

10. A sliding door arrangement comprising:

a sliding door having at least one wheel;

a rail system comprising at least a first rail on which said wheel is rollable and which guides a sliding motion of the door; and an attenuation and retraction device configured to:

brake the sliding motion of the door at a brake position in the vicinity of a door end position, and retract the door to the end position, the attenuation and retraction device having a slit which is aligned with said first rail, wherein said door comprises a pin having distal end which is aligned with said first rail and a proximal end which is attached to the door in a slideable way, and said pin is adapted to interact with said attenuation and retraction device when reaching the brake position by moving in the direction of the distal end, entering the slit, and travelling in the slit to the end position of the door, wherein the attenuation and refraction device is located in a linear extension that is adjacent to said first rail such that an end of the attenuation and retraction device abuts an end of said first rail.

11. A sliding door arrangement according to claim 10, wherein said first rail and said attenuation and retraction device are arranged to be mounted below the door.

12. A sliding door arrangement according to claim 11, wherein the pin has a thinner portion at the distal end and a thicker portion at the proximal end, the weight of the thicker portion exceeding the weight of the thinner portion by at least a factor 5.

13. A sliding door arrangement according to claim 11, wherein the pin is slideable in relation to the door, and the pin weighs 7 grams or more.

14. A sliding door arrangement according to claim 10, comprising a ramp surface at an interface between the first rail and the attenuation and retraction device, the ramp surface being arranged to guide the pin out of a slit in the attenuation and retraction device and up on a track of the first rail.

15. A sliding door arrangement comprising:

a sliding door having at least one wheel;

a rail system comprising at least a first rail on which said wheel is rollable and which guides a sliding motion of the door; and an attenuation and retraction device configured to brake the sliding motion of the door at a brake position in the vicinity of a door end position and to retract the door to the end position, the attenuation and retraction device having a slit, said door including a pin adapted to interact with said attenuation and retraction device when reaching the brake position by entering the slit, said first rail and said slit being aligned such that the slit begins where the first rail ends, wherein the attenuation and retraction device is comprised in a linear extension adjacent to said first rail such that an end of the extension abuts an end of said first rail.

16. A sliding door arrangement according to claim 15, wherein said first rail and said attenuation and retraction device are arranged to be mounted below the door.

17. A sliding door arrangement according to claim 16, wherein the pin has a thinner portion at the distal end and a thicker portion at the proximal end, the weight of the thicker portion exceeding the weight of the thinner portion by at least a factor 5.

18. A sliding door arrangement according to claim 16, wherein the pin is slideable in relation to the door, and the pin weighs 7 grams or more.

19. A sliding door arrangement according to claim 15, comprising a ramp surface at an interface between the first rail and the attenuation and retraction device, the ramp surface being arranged to guide the pin out of a slit in the attenuation and retraction device and up on a track of the first rail.

20. A sliding door arrangement according to claim 15, wherein the attenuation and retraction device is removeable from the sliding door arrangement without disturbing said first rail.

* * * * *